US006000152A

United States Patent [19]

Tate

[11] Patent Number: 6,000,152

[45] Date of Patent: Dec. 14, 1999

[54] CULVERT CLEANING APPARATUS

[76] Inventor: David LeRoy Tate, 10428 N.W. 63 St., Oklahoma City, Okla. 73099

[21] Appl. No.: 09/006,716

[22] Filed: Jan. 14, 1998

[51] Int. Cl.[6] ..... E02F 3/96; E02F 3/76

[52] U.S. Cl. ..... 37/405; 37/403; 37/407

[58] Field of Search ..... 37/403, 405, 407; 414/912

[56] References Cited

U.S. PATENT DOCUMENTS

| | | | |
|---|---|---|---|
| 576,945 | 2/1897 | Brenneman . | |
| 584,508 | 6/1897 | Hughes . | |
| 821,560 | 5/1906 | Warren . | |
| 2,840,932 | 7/1958 | Breyer | 37/403 |
| 4,037,681 | 7/1977 | Gorby | 180/44 R |
| 4,189,854 | 2/1980 | Haynes | 37/117.5 |
| 4,571,146 | 2/1986 | Eriksson | 414/687 |
| 4,819,349 | 4/1989 | Mensch | 37/117.5 |
| 5,486,085 | 1/1996 | Gagne et al. | 414/724 |

FOREIGN PATENT DOCUMENTS

| | | | |
|---|---|---|---|
| 607667 | 11/1960 | Canada | 37/403 |

*Primary Examiner*—Thomas B. Will
*Assistant Examiner*—Gary S. Hartmann
*Attorney, Agent, or Firm*—Robert Treece

[57] ABSTRACT

A culvert cleaning apparatus of use with earth moving machinery having a bucket, such as a backhoe or trackhoe. The apparatus has an attachment assembly for connection to the machinery's bucket with an arm extending therefrom for securing a scoop. Extensions between the attachment assembly and the scoop are provided when extended reach is desired. The machine may be used to push the scoop into a culvert and scoop out material clogging the culvert.

10 Claims, 3 Drawing Sheets

CULVERT CLEANING APPARATUS

BACKGROUND OF THE INVENTION

1. Field of the Invention

The present invention relates to attachments assemblies for mounting on other earth moving machinery such as a trackhoe or backhoe for purposes of cleaning out existing, in-place culverts used for water drainage below such things as roadways. Drainage structures often carry dirt, garbage, leaves, and the like that will impede the structures primary function of draining water. This invention will allow the power of earth moving machinery placed on the roadway to send a digging and or cleaning tool into the culvert to remove obstructions.

2. Description of the Prior Art

In the past, cleaning culverts required a person going down into the culvert and using hand tools, such as long shovels, hoes, and rakes, or using pressurized water from a hose to remove obstructions like dirt, leaves, and trash from the culvert. Obviously, these methods were limited by the power of the person or likewise the power of the water in the hose to remove obstructions. Furthermore, the ability to reach obstructions in long culverts depended on whether the culvert was large enough in diameter for a person to crawl into to reach the obstruction with hand tools. The use of water pressure is also limited by the access to a water source and capability of creating enough pressure to remove obstructions in long culverts.

SUMMARY OF THE INVENTION

In view of the foregoing disadvantages inherent in the known methods and types of culvert cleaning devices now present in the prior art, the present invention provides an improved construction wherein the same can be utilized reliably in those situations where the prior art was limited to hand powered tools. As such, the general purpose of the present invention, which will be described subsequently in greater detail, is to provide a new and improved culvert cleaning apparatus and method which has all the advantages of the prior art devices and none of the disadvantages.

To attain this, the present invention essentially comprises a removable pivotal attachment assembly to a bucket of an earth moving machine, such as but not limited to a trackhoe or backhoe, an arm that has various lengths depending on the desired length needed to reach an obstruction in a culvert, and finally a digging or scooping attachment that travels inside the culvert to clear the obstruction.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved culvert cleaning apparatus which may be easily and efficiently manufactured and marketed.

It is a further object of the present invention to provide a new and improved culvert cleaning apparatus which is of a durable and reliable construction.

An even further object of the present invention is to provide a new and improved culvert cleaning apparatus which is susceptible of a low cost of manufacture with regard to both materials and labor, and which accordingly is then susceptible of low prices of sale to the consuming public, thereby making such apparatus economically available to the buying public.

Still another object of the present invention is to provide a new and improved culvert cleaning apparatus and method which provides some of the advantages of the prior art, while simultaneously overcoming some of the disadvantages normally associated therewith.

Another object of the present invention is to provide a new and improved culvert cleaning apparatus that is easily and quickly affixed to earthmoving equipment such as but not limited to trackhoes or backhoes.

Yet another object is to allow flexibility of the invention to be used in variable length culverts that are either round or square.

And another object is to give the earthmoving machine used a stable platform of the roadway to operate due to the inventions ability to pivot along a horizontal axis perpendicular to the alignment of the culvert and its ability to slide along the axis for greater flexibility.

Still another object of the invention is to allow the tilting of the various scoops to accommodate holding debris as it is being removed from the culvert by changing the pitch of the earthmoving machine bucket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
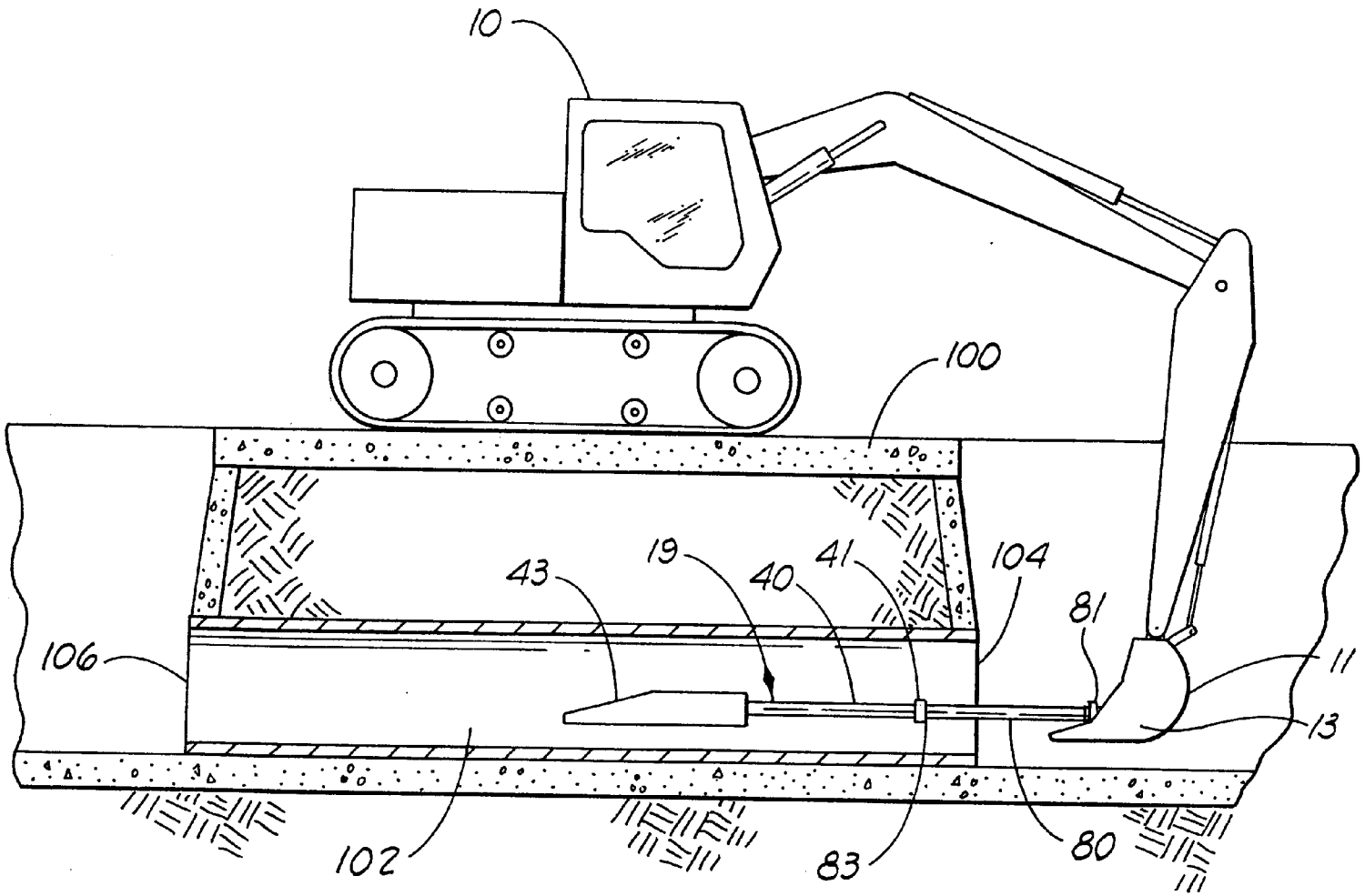
FIG. 1 is a side view of the invention attached to a trackhoe which sits on a roadway over a culvert with one of the invention's implement heads entered into a culvert.

Referring to the drawing in detail and to FIG. 1. in particular, reference character 19 generally designates a culvert cleaning apparatus constructed in accordance with the present invention.

Figure 2:
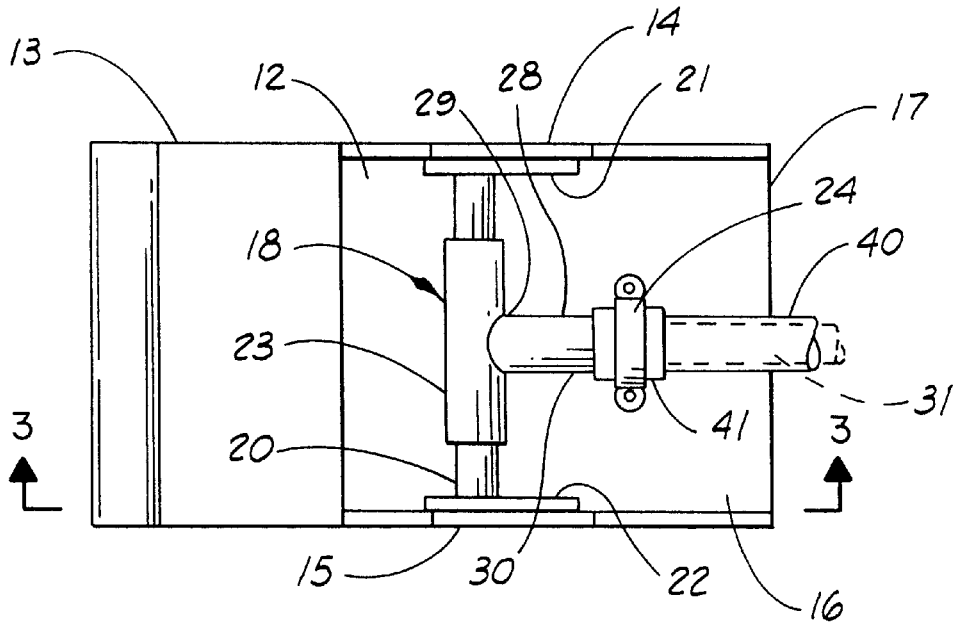
FIG. 2 is an overhead view of the invention's pivotal attachment assembly connected to the interior of a bucket of a trackhoe.
Figure 3:
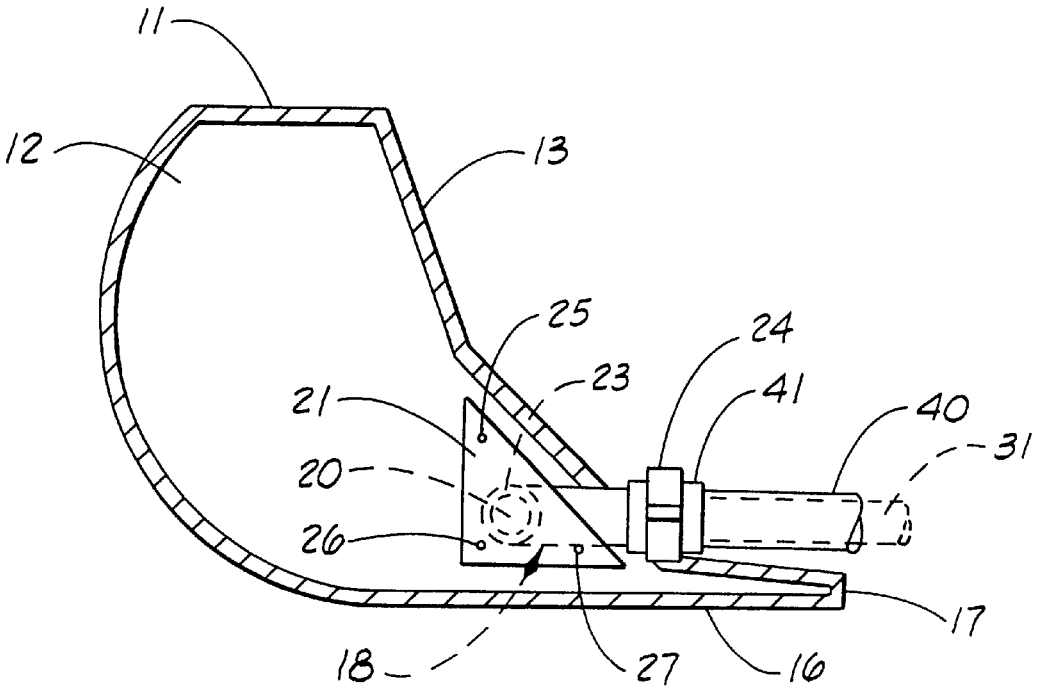
FIG. 3 is a sectional view taken along line 3—3 in FIG. 2.

Referring to the drawings and FIG. 1, FIG. 2, and FIG. 3 in particular, the invention 19 is removably attached to an earth moving machine, such as a trackhoe 10, that is provided with a hydraulically controlled bucket 11. The bucket 11 is generally comprised of an interior surface 12, an exterior surface 13, a pair of generally vertical, parallel, oppositely-disposed side panels 14 and 15, and a scoop panel 16 having a cutting edge 17, defining an interior volume. The bucket 10 is pivotally attached to the trackhoe and is preferably fabricated from steal or a similar material.

Referring to the drawings in detail and more specifically FIG. 2 and FIG. 3, the pivotal attachment assembly 18 is generally comprised of an elongated member 20, a sleeve 23, and a coupling device 24. A preferred embodiment of the elongated member 20 is a hollow or solid steel pipe with first and second ends. Steel plate brackets 21 and 22 are preferably welded to the elongated member (other connecting means may be used, by way of example, and not of limitation, cup shaped caps could be secured to the bucket side panels and the ends of the elongated member could then be held to the bucket by being placed in the cups; yet another connecting means is to provide brackets which attach to the side panels and allow the elongated members to pass through the brackets and past the edges of the panels). If end plates are used, each plate 21 and 22 should be removably attached to side panels 14 and 15 respectively. One preferred embodiment would be with screws and bolts 25, 26, and 27. Another means for attaching the elongated member is to place holes in the bucket 11 side panels 14 and 15 and allow the elongated member 20 to pass through the bucket 11 side panels 14 and 15. Then, if desired one could removably connect on the bucket exterior surface 13. However, this method is not preferred since it requires rather large holes to be placed in the bucket. In the preferred embodiment member 20, is fitted with a sleeve 23 that covers the outside and rotates around member 20. An arm 28 with first end 29 connected to the sleeve and second end 30 extending out therefrom is provided to allow attachment of various scoops. This arrangement allows the arm some rotational and translational movement thereby requiring less precise placement and movement of the bucket. It should be noted that the desired movement of the arm may also be accomplished is several other ways (some of which are mentioned above) including but not limited to allowing the elongated member to rotate at its connection to the sidewalls. As mentioned before sleeve 23 along with arm 28 are generally shaped like a "T" such that a perpendicular section connects the length of the sleeve and allows for a coupling device 24 for attaching implements heads 40 and 60 and extension member 80. One preferred embodiment is that the sleeve is made of steel pipe and its length is shorter than the member to allow the sleeve to slide freely along at least a portion of the member 20 to allow some generally horizontal flexibility to the invention 19 (i.e. translational movement).

Another preferred embodiment would be adding a bracing rod 31 made from a steel pipe of which would have a smaller diameter than the arm 28, implement head member length 42 and 62, and extension member length 82 and a shorter length than the length of implement head member length 42 and 62, and extension member length 82. Bracing rod 31 would be welded to arm 28 second end 30. Bracing rod 31 would serve as a support for the weight and aligning of attaching implement heads 40 and 60 and extension member 80 by allowing them to slide over the bracing rod 31 while being attached to the pivotal attachment assembly 18.

Figure 4:
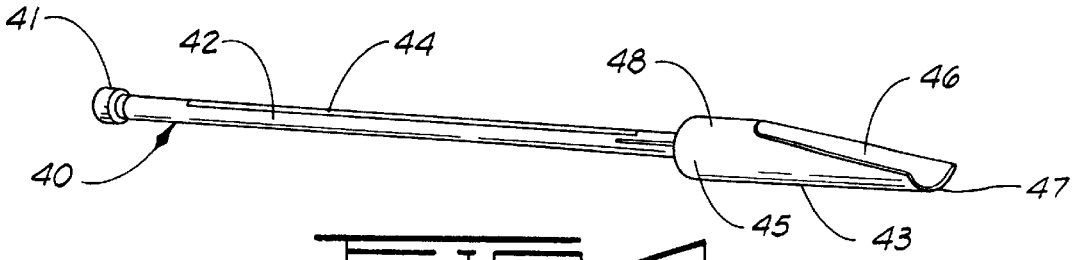
FIG. 4 is a perspective view of an embodiment of the invention showing a scoop for generally round culverts.
Figure 5:
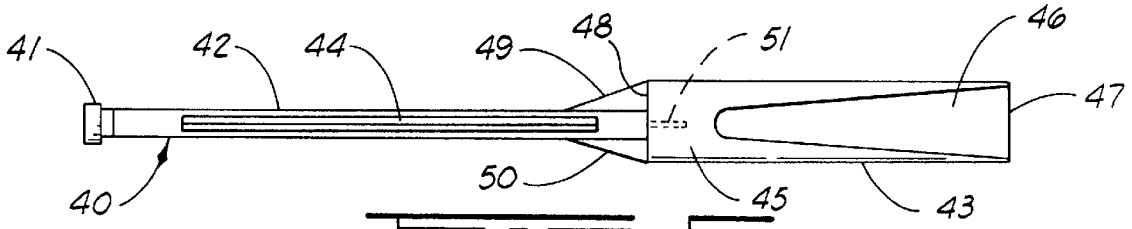
FIG. 5 is a side view of the embodiment featured in FIG. 4

Referring to the drawings and FIG. 4 and FIG. 5 specifically, implement head 40 consists of a coupling device 41, a member length 42, and a generally rounded shape scoop 43. A preferred embodiment of implement head 40 would be of steel where the member length 42 is made of steel pipe and steel reinforcement 44. A preferred embodiment of the coupling device 41 would be threaded screw or hammer joint connector. Said coupling device 41 would attach to coupling device 24 and 83.

The rounded scoop 43 is generally comprised of a cylindrical shaped exterior 45, an interior 46, a front edge 47, and a back plate 48. A preferred embodiment would be a large diameter steel pipe cut to form a scoop at one end of the pipe and a steel backplate welded to the other end of the pipe. The rounded scoop 43 is fixedly attached to the member length with a preferred embodiment of reinforcement with angle bracing 49, 50 and 51.

Figure 6:
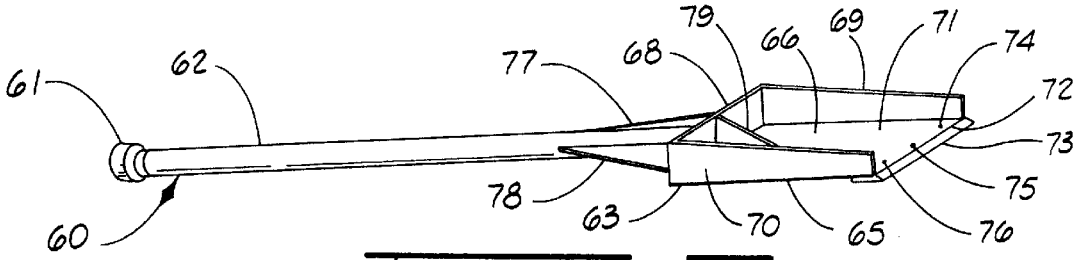
FIG. 6 is a perspective view of an embodiment to the invention showing a scoop for generally square culverts.
Figure 7:
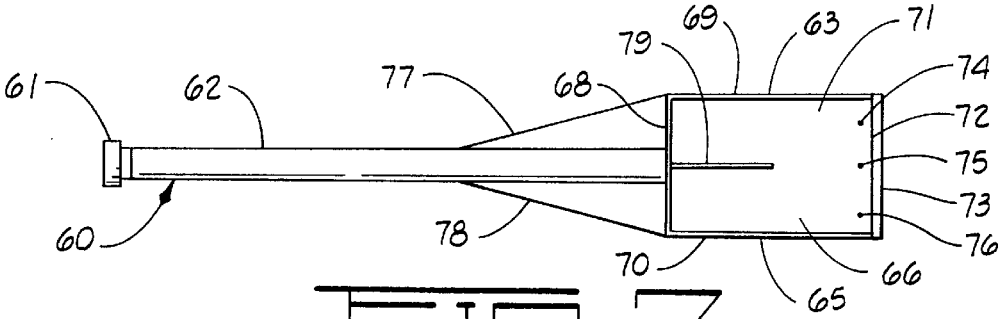
FIG. 7 is a side view of the embodiment featured in FIG. 6.

Referring to the drawings and FIG. 6 and FIG. 7 specifically, implement head 60 consists of a coupling device 61, a member length 62, and a generally square shaped scoop 63. A preferred embodiment of implement head 60 would be of steel where the member length 62 would be of pipe with steel reinforcement such as another pipe placed inside. A preferred embodiment of the coupling device 61 would be threaded screw or hammer joint connector. Said coupling device 61 would attach to coupling device 24 and 83.

The square scoop 63 generally comprises a box like exterior surface 65, an interior surface 66, a backplate 68, and a pair of generally vertical, parallel, oppositely-disposed side panels 69 and 70, and a scoop panel 71 having a front edge 72, defining an interior volume. Attached to the front edge 72 is a removably attached cutting edge 73. A preferred embodiment being a beveled steel plate attached with bolts 74, 75, and 76 to the bottom of the of the front edge 72. Backplate 68 is fixedly attached to member length 62 with a preferred embodiment of a welded angle reinforcements plates 78 and 77. Another preferred embodiment would be placement of angle reinforcement plate 79 connecting backplate 68 and scoop panel 71.

Figure 8:
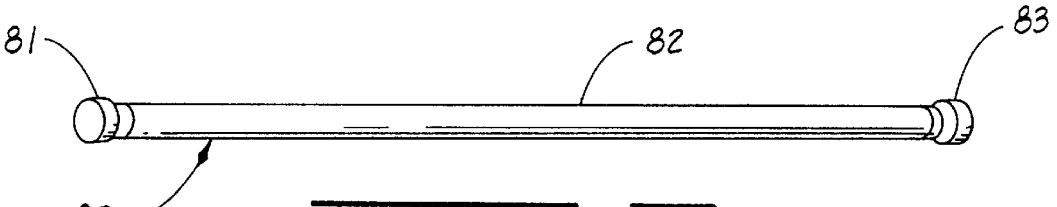
FIG. 8 is a perspective of an extension that may be added in plurality between the pivotal attachment assembly located in the bucket as shown in FIG. 2 and the embodiments shown in FIG. 4 and FIG. 6.

Referring to the drawings and more specifically FIG. 8, extension member 80 generally consists of a coupling device 81, a member length 81, and another coupling device 83. A preferred embodiment of extension member 80 is made of steel pipe with steel reinforcement. Coupling device 81 would attach to coupling device 24. Coupling device 83 would attach to either the above mentioned implements head coupling devices 41 or 61 and act as an extension for the implement heads. Depending on the overall desired length needed for reaching into the culvert, combinations of more than one extension member 80 with the desired implement head could be used. A preferred embodiment of coupling devices 81 and 83 would be a threaded screw or hammer joint connectors.

OPERATION OF THE ILLUSTRATED EMBODIMENT

In operation, the invention 19's pivotal attachment assembly 18 is bolted to the rear bucket 11 of a trackhoe 10. The trackhoe 10 is placed on the roadway 100 that covers the culvert 102 and is generally aligned over the length of the culvert 102. Depending on the whether the culvert 102 is box shaped or cylindrical, the appropriate desired implement head 40 or 60 is then placed on the pivotal attachment assembly 18 with hammer joints. The bucket 11 of the backhoe 10 is then lowered below the level of the roadway 100 and into the culvert opening 104. The chosen implement head travels into the culvert 102 and scoops up the debris by the operation of the trackhoe 10. By changing the angle of the bucket 11 the operator of the trackhoe 10 can tilt the invention 19 back so that the debris in the scoop slides to the back of the scoop. Once the debris is in the scoop, the chosen implement head can be pulled back out of the culvert 102 and then the accumulated debris can be dumped out of the scoop by tilting the invention 19 forward. This process is repeated from the other end of the culvert, culvert opening 106, until the culvert 102 is cleared of obstructions. When necessary to reach the middle of the culvert 102, extension member 80 is added between the chosen implement head and the pivotal attachment assembly 18. Multiple combinations of added extension member 80 can be added for further reach into the culvert 102 when needed.

I claim:

1. A culvert cleaning apparatus for use with earth moving machinery having a bucket with opposing side panels, comprising:

an attachment assembly extending across said bucket and attached to the opposing bucket side panels wherein the attachment assembly includes an elongated member with a first and a second end, each elongated member end having a removable fastening device for removably connecting the attachment assembly to the side panels of the bucket; and further comprising: a sleeve around said elongated member and capable of rotational movement on said elongated member, said sleeve connected to the first end of said arm member thereby allowing the arm member to pivot in relationship to said bucket;

an arm member having a first end and second end with the first end connected to the attachment assembly, said arm extending generally perpendicularly outwardly away from the attachment assembly to said second end; and a scoop connected to the second end of said arm member for digging and removing material from a culvert.

2. The apparatus of claim 1 wherein the second end of said arm member is removably connected to the scoop.

3. The apparatus of claim 2 wherein the removable connection between the second end of the arm member and the scoop is a hammer joint.

4. The apparatus of claim 2 further comprising; an extension having a first end and a second end, wherein the second end of said arm member is removably connected to the first end of the extension, and the second end of the extension is removably connected to the scoop.

5. The apparatus of claim 4 wherein the removable connection between the second end of the arm member and first end of the extension is a hammer joint and wherein the removable connection between the second end of the extension and the scoop is a hammer joint.

6. The apparatus of claim 2 wherein the scoop comprises:

a hollow cylinder forming side walls, said cylinder having a front end and a rear end, wherein a portion of the front end is cut away to form a scoop shape having an open top and a closed bottom;

a generally planer back end plate connected to the rear end of the hollow cylinder to close the rear end thereof; and a handle connected to the generally planer back end plate and extending out therefrom to a handle end.

7. The apparatus of claim 6 further comprising a hammer joint connector secured to the handle end.

8. The apparatus of claim 1 wherein the elongated member has a length, and the sleeve has a length, and wherein the length of the sleeve is less than the length of the elongated member allowing the sleeve to slide along at least a portion of the length of the elongated member.

9. The apparatus of claim 1 wherein each of the removable fastening devices for connecting to a side panel comprises a plate secured to the elongated member and bolted a bucket side panel.

10. The apparatus of claim 1 wherein the scoop comprises:

a pair of oppositely-disposed side panels a generally planer bottom plate connected to the oppositely-disposed side panels;

a planer rear member connected to the oppositely-disposed side panels and to the bottom plate; and a handle connected to the rear member and extending out therefrom.

* * * * *